US007537004B2

(12) United States Patent
Reay

(10) Patent No.: US 7,537,004 B2
(45) Date of Patent: May 26, 2009

(54) STEAM OVEN WITH FLUID SUPPLY AND DRAIN VESSEL

(75) Inventor: Malcolm Reay, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 680 days.

(21) Appl. No.: 11/120,407

(22) Filed: May 3, 2005

(65) Prior Publication Data

US 2006/0249136 A1 Nov. 9, 2006

(51) Int. Cl.
*F24D 1/00* (2006.01)
*A21B 1/08* (2006.01)

(52) U.S. Cl. ..... 126/369; 126/20

(58) Field of Classification Search ..... 126/369, 126/20, 5, 369.3; 122/18.1
See application file for complete search history.

(56) References Cited

U.S. PATENT DOCUMENTS

| | | | | |
|---|---|---|---|---|
| 4,655,192 | A | 4/1987 | Jovanovic | 126/20 |
| 5,318,792 | A | 6/1994 | Tippmann | 426/510 |
| 5,355,840 | A * | 10/1994 | Violi | 392/401 |
| 5,515,773 | A | 5/1996 | Bullard | 99/330 |
| 5,552,578 | A | 9/1996 | Violi | 219/401 |
| 5,640,946 | A | 6/1997 | Oslin | 126/29 |
| 5,680,810 | A * | 10/1997 | Sham | 99/330 |
| 6,202,637 | B1 | 3/2001 | Roberts | 126/20 |
| 6,233,464 | B1 | 5/2001 | Chmaytelli | 219/401 |
| 6,453,802 | B1 | 9/2002 | Manganiello et al. | 99/330 |
| 6,545,251 | B2 | 4/2003 | Allera et al. | 219/394 |
| 6,666,086 | B2 * | 12/2003 | Colman et al. | 73/304 C |
| 6,773,738 | B2 | 8/2004 | Berger et al. | 426/510 |
| 7,091,454 | B2 * | 8/2006 | Cho et al. | 219/401 |
| 2003/0132312 | A1 * | 7/2003 | Kelly | 239/310 |

FOREIGN PATENT DOCUMENTS

| | | |
|---|---|---|
| DE | 4303656 | 8/1994 |
| DE | 19741881 | 3/1999 |
| EP | 0277337 | 8/1988 |

OTHER PUBLICATIONS

European Search Report EP 06112609.0 Dated Sep. 29, 2006.

* cited by examiner

*Primary Examiner*—Kenneth B Rinehart
*Assistant Examiner*—Chuka C Ndubizu
(74) *Attorney, Agent, or Firm*—John Morrison; Michael D. Lafrenze

(57) ABSTRACT

An oven comprises a cooking cavity, a steam generator operably connected to the cooking cavity for introducing steam into the cooking cavity, and a portable vessel removably mounted to the oven for supplying water to the steam generator and receiving drain water from the steam generator.

22 Claims, 5 Drawing Sheets

STEAM OVEN WITH FLUID SUPPLY AND DRAIN VESSEL

BACKGROUND OF THE INVENTION

1. Field of the Invention

The invention relates to a steam oven with a removable vessel for supplying fluid to a steam generator and for receiving fluid drained from the steam generator.

2. Description of the Related Art

Steam ovens typically comprise a heating system, as in a conventional oven, for heating a cooking cavity and a steam system for generating steam from water and introducing the steam into the cooking cavity to facilitate the baking process. Water can be supplied to the steam system from a main water supply or by a user through a water inlet accessible to the user. In the latter case, the inlet can be adapted to receive water directly poured by the user or to mate with a portable vessel that stores a supply of water. The manner in which water is provided to the steam generator is particularly important for household ovens. The dimensions of household ovens, whether freestanding or built-in, are set by industry standards, and, preferably, the amount of space dedicated to the water supply system (and other systems of the oven) is minimized so as to maximize the size of the cooking cavity. Thus, water supply systems that do not diminish the size of the cooking cavity are desirable.

Some steam ovens further include a separate drain system to drain water from the steam system. The drain system directs unused water to a main water drain or a storage tank accessible by the user. The draining feature can be used for maintaining the oven and to remove water from the steam generator when the steam system is only occasionally employed. Drainage systems can also be used for passing descaling agents through the steam system to remove the hard mineral coating that tends to form on the inside surfaces of the steam generator. The user can introduce the descaling agent into the steam system as a fluid through the water supply inlet, and, after removal of the hard mineral coating, the descaling agent leaves the steam system through the drain system.

SUMMARY OF THE INVENTION

An oven according to one embodiment of the invention comprises a housing defining a cooking cavity, a steam generator having an inlet for receiving water, a drain, and a steam outlet operably connected to the cooking cavity for introducing steam into the cooking cavity, and a portable vessel removably mounted to the oven and having an outlet and an inlet, which are fluidly coupled to the steam generator inlet and drain, respectively, when the portable vessel is mounted to the oven, whereby the portable vessel supplies water to the steam generator and receives drain water from the steam generator.

The oven can further comprise a pump for pumping water from the drain to the vessel inlet. The pump can be located between the drain and the vessel inlet. The oven can further comprise a switch operable by a user to control operation of the pump. The oven can further comprise a sensor operable to detect the presence of the portable vessel when the portable vessel is mounted to the oven. The sensor can be operably coupled to the switch such that the switch can only be actuated to activate the pump when the sensor detects the presence of the portable vessel. The oven can further comprise a docking station that mates with the portable vessel and fluidly couples the portable vessel with the steam generator when the portable vessel is mounted to the oven.

The oven can further comprise a water reservoir fluidly coupled to the steam generator inlet and to the vessel outlet when the portable vessel is mounted to the oven. The oven can further comprising a valve downstream of the vessel outlet to control flow of water from the portable vessel to the water reservoir. The oven can further comprise a water level sensor operable to detect a level of water in the water reservoir and operably coupled to the valve to control the flow of water from the portable vessel to the water reservoir based on the detected level of water. The steam generator can comprise a chamber fluidly coupled to and positioned adjacent to the water reservoir.

The portable vessel can comprise a water supply chamber fluidly connected to the vessel outlet and a water drain chamber fluidly connected to the vessel inlet. The portable vessel can further comprise a recloseable lid that selectively closes at least one of the water supply chamber and the water drain chamber when mounted to the portable vessel. The portable vessel can further comprise a handle.

An oven according to another embodiment of the invention comprises a housing defining a cooking cavity, a steam generator having an inlet for receiving water and a steam outlet operably connected to the cooking cavity for introducing steam into the cooking cavity, a portable vessel removably mounted to the oven and having an outlet fluidly coupled to the steam generator inlet when the portable vessel is mounted to the oven, whereby the portable vessel supplies water to the steam generator, a water reservoir fluidly coupled to the steam generator inlet and to the vessel outlet when the portable vessel is mounted to the oven to store water supplied from the portable vessel, and a valve downstream of the vessel outlet and responsive to a level of water in the water reservoir to control the flow of water from the portable vessel to the water reservoir.

The oven can further comprise a water level sensor operable to detect the level of water in the water reservoir and operably coupled to the valve to control the flow of water from the portable vessel to the water reservoir based on the detected level of water. The water level sensor can comprise a conductivity sensor. The steam generator can comprise a chamber fluidly coupled to and positioned adjacent to the water reservoir.

DESCRIPTION OF THE PREFERRED EMBODIMENT

Figure 1:
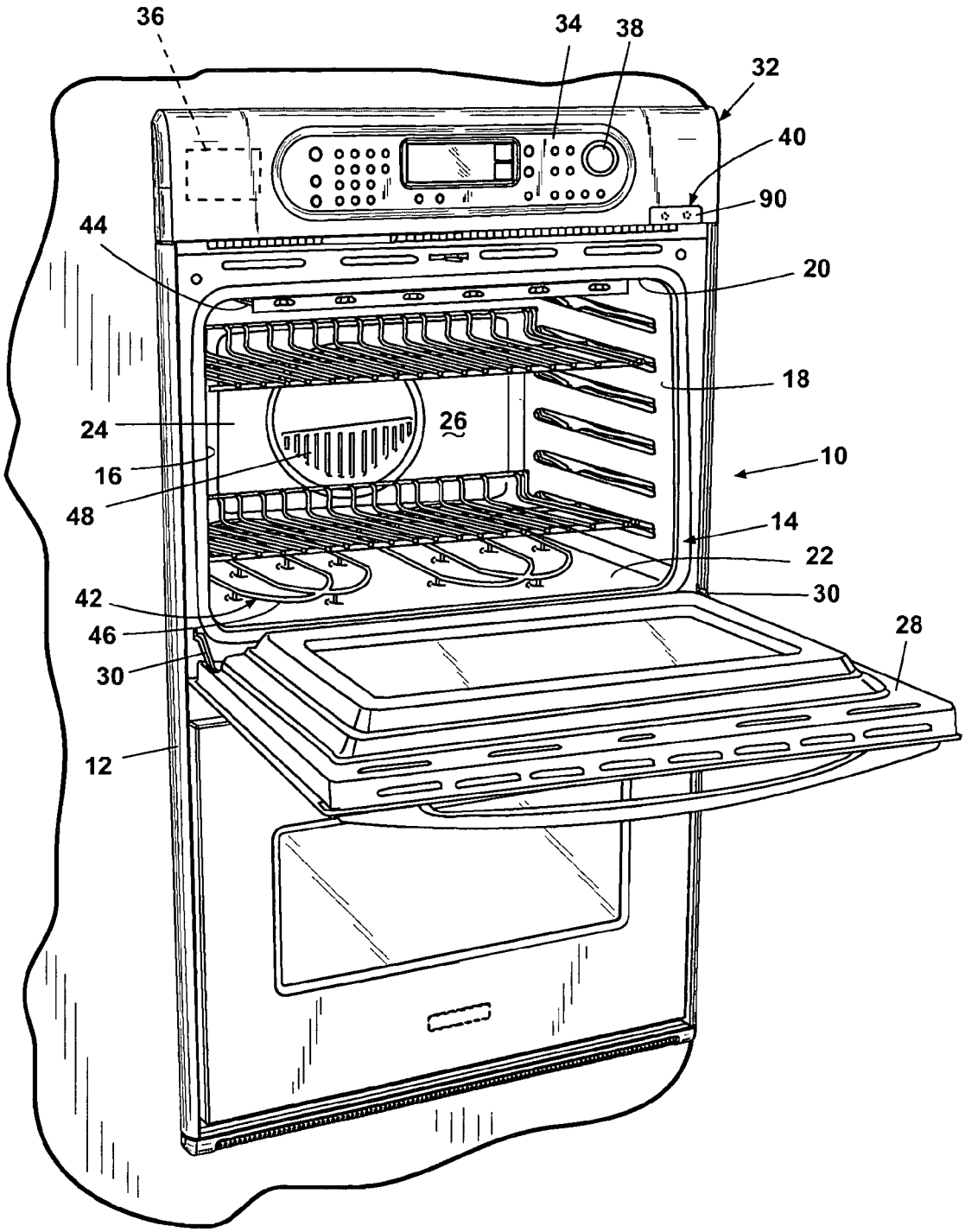
FIG. 1 is a perspective view of an oven according to one embodiment of the invention.

Referring now to the figures, FIG. 1 illustrates an exemplary automatic household oven 10 comprising a cabinet 12 with an open-face housing 14 having a pair of spaced side walls 16, 18 joined by a top wall 20, a bottom wall 22, and a rear wall 24 to define an open-face cooking cavity 26. A door 28 pivotable at a hinge 30 selectively closes the cavity 26, as is well-known in the oven art. When the door 28 is in the open position, a user can access the cavity 26, while the door 28 in the closed position prevents access to the cavity 26 and seals the cavity 26 from the external environment. The oven 10 shown in the figures is a built-in oven, but it is within the scope of the invention for the oven to be a freestanding oven.

The oven 10 further comprises a console 32 with a control panel 34 accessible to the user for inputting desired cooking parameters, such as temperature and time, of manual cooking programs or for selecting automated cooking programs. The control panel 34 communicates with a controller 36 located in the cabinet 12. The controller 36 can be a proportional-integral-derivative (PID) controller or any other suitable controller, as is well-known in the automatic oven art. The controller 36 stores data, such as default cooking parameters, the manually input cooking parameters, and the automated cooking programs, receives input from the control panel 34, and sends output to the control panel 34 for displaying a status of the oven 10 or otherwise communicating with the user. Additionally, the console 32 includes a drain switch 38 and a vessel docking station 40, which will be described in more detail below.

With continued reference to FIG. 1, the oven 10 further comprises a heating system 42 having an upper heating element 44, commonly referred to as a broiler, and a lower heating element 46. FIG. 1 shows the lower heating element 46 as being mounted just above the cooking cavity bottom wall 22; however, it is within the scope of the invention for the lower heating element 46 to be hidden or mounted below the bottom wall 22. Further, the upper and lower heating elements 44, 46 can be mounted at the side walls 16, 18 of the cavity 26, as disclosed in U.S. Pat. No. 6,545,251 to Allera et al., which is incorporated herein by reference in its entirety. The heating system 42 according to the illustrated embodiment further comprises a convection fan 48 that circulates air and steam, when present, within the cavity 26. The convection fan 48 can be any suitable fan and can be mounted in any suitable location of the cavity 26, such as in the rear wall 24. The particular type of heating system is not germane to the invention; the heating system 42 shown and described herein is for illustrative purposes only and is not meant to limit the invention in any manner.

Figure 2:
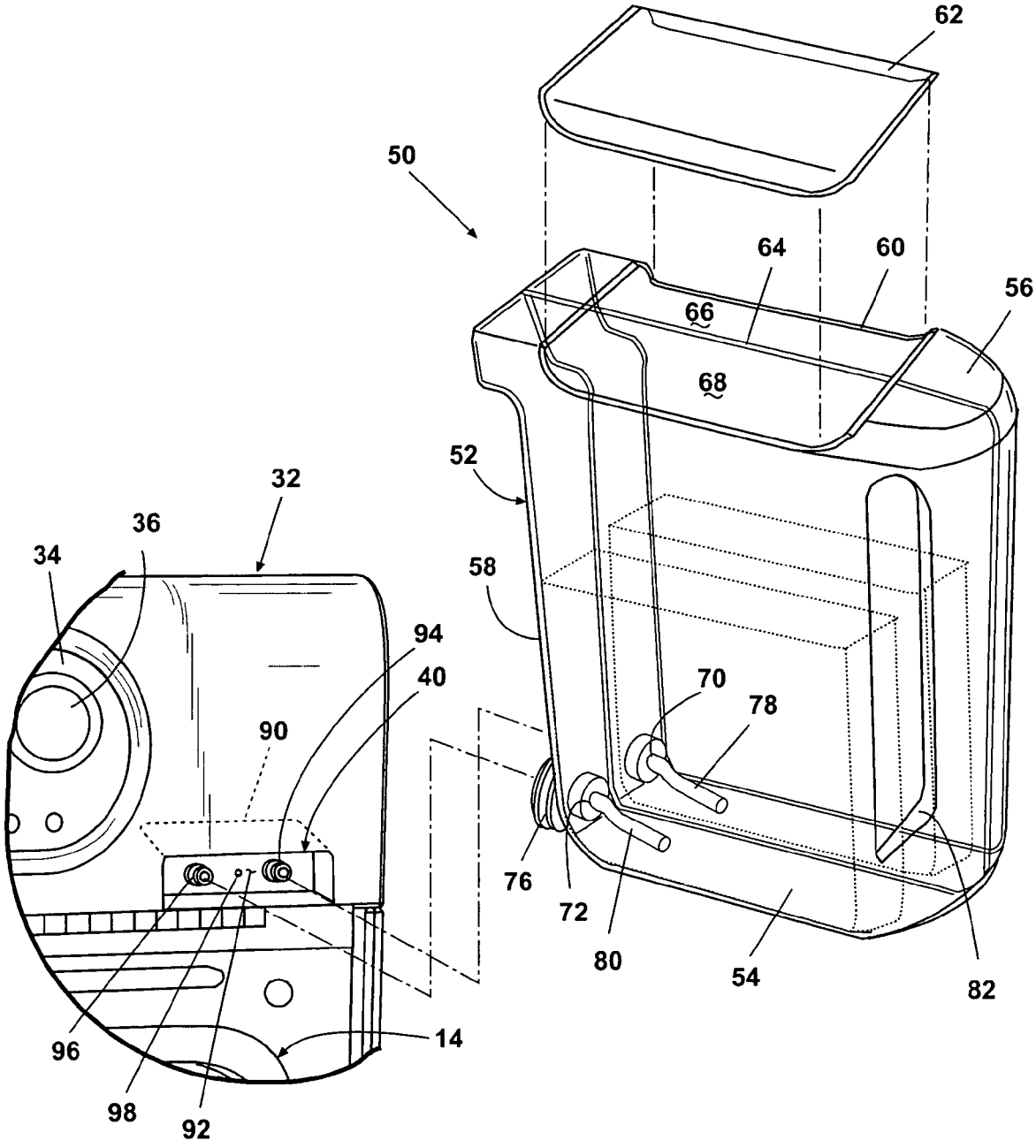
FIG. 2 is an exploded view of a console of the oven shown in FIG. 1 and a portable supply and drain vessel according to one embodiment of the invention that mates with a docking station on the console to supply water to and to drain water from a steam system of the oven.
Figure 3:
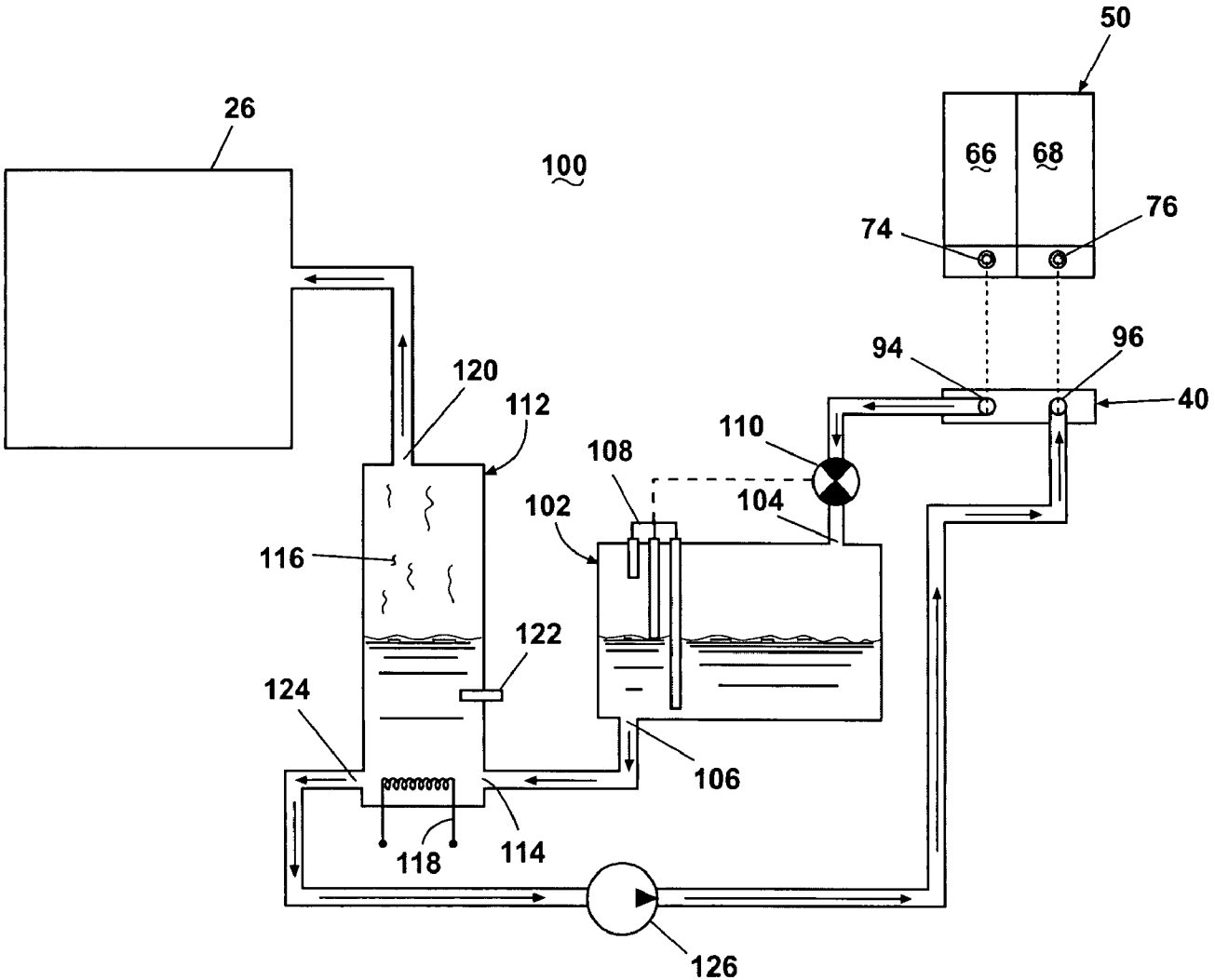
FIG. 3 is a schematic view of the steam system according to one embodiment of the invention for the oven shown in FIG. 1

In addition to the heating system, the oven 10 comprises a portable vessel 50, shown in FIG. 2, for supplying water to and receiving water drained from a steam system 100, which is illustrated schematically in FIG. 3. Referring particularly to FIG. 2, the vessel 50 comprises a generally hollow tank 52 defined by a peripheral wall 58 extending between spaced bottom and top walls 54, 56. The top wall 56 forms an opening 60 that is selectively closed by a recloseable lid 62, which as illustrated is removably mounted to effect the reclosing. Within the tank 52, a dividing wall 64 extending generally upward from and generally perpendicular to the bottom wall 54 separates the hollow interior of the tank 52 into an open-top water supply chamber 66 and an open-top water drain chamber 68 that are closed when the lid 62 is mounted to the tank 52. Each of the chambers 66, 68 has a corresponding fluid port 70, 72 equipped with a normally closed valve 74, 76, such as a spring-biased valve, and, optionally, a fluid conduit 78, 80 leading from the interior of the chamber 66, 68 to the corresponding fluid port 70, 72. The fluid port 70 for the water supply chamber 66 functions as an outlet, while the fluid port 72 for the water drain chamber 68 functions as an inlet. According to the illustrated embodiment, the fluid ports 70, 72 are located near the bottom wall 54 so that the water or other fluid contained in the water supply chamber 66 can flow by gravity from the water supply chamber 66 through the outlet fluid port 70. The vessel 50 in the illustrated embodiment further comprises a grip or handle 82 to facilitate grasping of the vessel 50 by the user.

With continued reference to FIG. 2, the vessel 50 is removably mounted to the docking station 40 in the console 32. The docking station 40 comprises a pivotable door 90 that selectively closes a cavity 92 formed in the console 32. A pair of valve receivers 94, 96 are mounted within the cavity 92 and are sized to mate with the valves 74, 76 of the vessel 50 when the vessel 50 is mounted to the docking station 40. When the valve receivers 94, 96 receive the normally closed valves 74, 76, the valves 74, 76 open to establish fluid communication between the vessel 50 and the steam system 100. The docking station 40 further comprises a vessel sensor 98 that detects the presence of the vessel 50 when the vessel 50 is mounted to the docking station 40. The vessel sensor 98 can be any suitable type of sensor, including, but not limited to, an infrared sensor, a sonic sensor, or a pressure sensitive sensor.

Referring now to FIG. 3, the steam system 100 comprises a water reservoir 102 having an inlet 104 in fluid communication with the valve receiver 94 that receives the valve 74 of the water supply chamber 66 and an outlet 106 in fluid communication with a steam generator 112. The water reservoir 102 is sized to store a desired amount of water, and the level of water in the water reservoir 102 is detected by a water level sensor 108, such as a conductivity sensor. The water level sensor 108 is operably coupled to a reservoir valve 110 positioned between the vessel 50 and the water reservoir 102 for controlling the flow of water from the water supply chamber 66 to the water reservoir 102 through the inlet 104. When the water level sensor 108 detects that the water reservoir 102 is sufficiently full, the valve 110 closes to prevent water from continuing to flow into the water reservoir 102. The water level sensor 108 can optionally be operably coupled to the control panel 34 to communicate to the user, such as through a visual display, a water level of the water reservoir 102 so that the user can determine whether to supply water to the water reservoir 102 through the vessel 50.

The outlet 106 of the water reservoir 102 is fluidly connected to an inlet 114 of the steam generator 112. The inlet 114 leads into a chamber 116 that holds a supply of water provided from the water supply chamber 66 via the water reservoir 102. According to the illustrated embodiment, the chamber 116 is positioned adjacent to the water reservoir 102 such that the water flows from the water reservoir 102 to the chamber 116 under gravity, and the level of water in the chamber 116 is the same as the level of water in the water reservoir 102. As a result of this configuration, the water level sensor 108 also indirectly detects the level of water in the steam generator 112. The water in the chamber 116 is heated by an evaporation element 118, such as a resistance heater, to at least the boiling point of water so that the water converts to steam and leaves the chamber 116 through a steam outlet 120 for introduction into the cooking cavity 26.

Optionally, the steam generator 112 can further comprise a temperature sensor 122 to detect the temperature of the water in the chamber 116. The steam generator 112 further includes a drain 124 fluidly coupled to the valve receiver 96 that receives the valve 76 of the water drain chamber 68; thus, the drain 124 is fluidly coupled to the water drain chamber 68 when the vessel 50 is mounted to the docking station 40. Optionally, the steam system 100 can incorporate a safety system comprising the temperature sensor 122 for preventing draining of dangerously hot water from the steam generator 112 to the vessel 50. An exemplary safety system is disclosed in Ser. No. 11/120,408, filed concurrently herewith, which is incorporated herein by reference in its entirety. A pump 126 positioned between the drain 124 and the water drain chamber 68 pumps water from the chamber 116 to the water drain chamber 68 upon actuation of the aforementioned drain switch 38 by the user.

Figure 4:
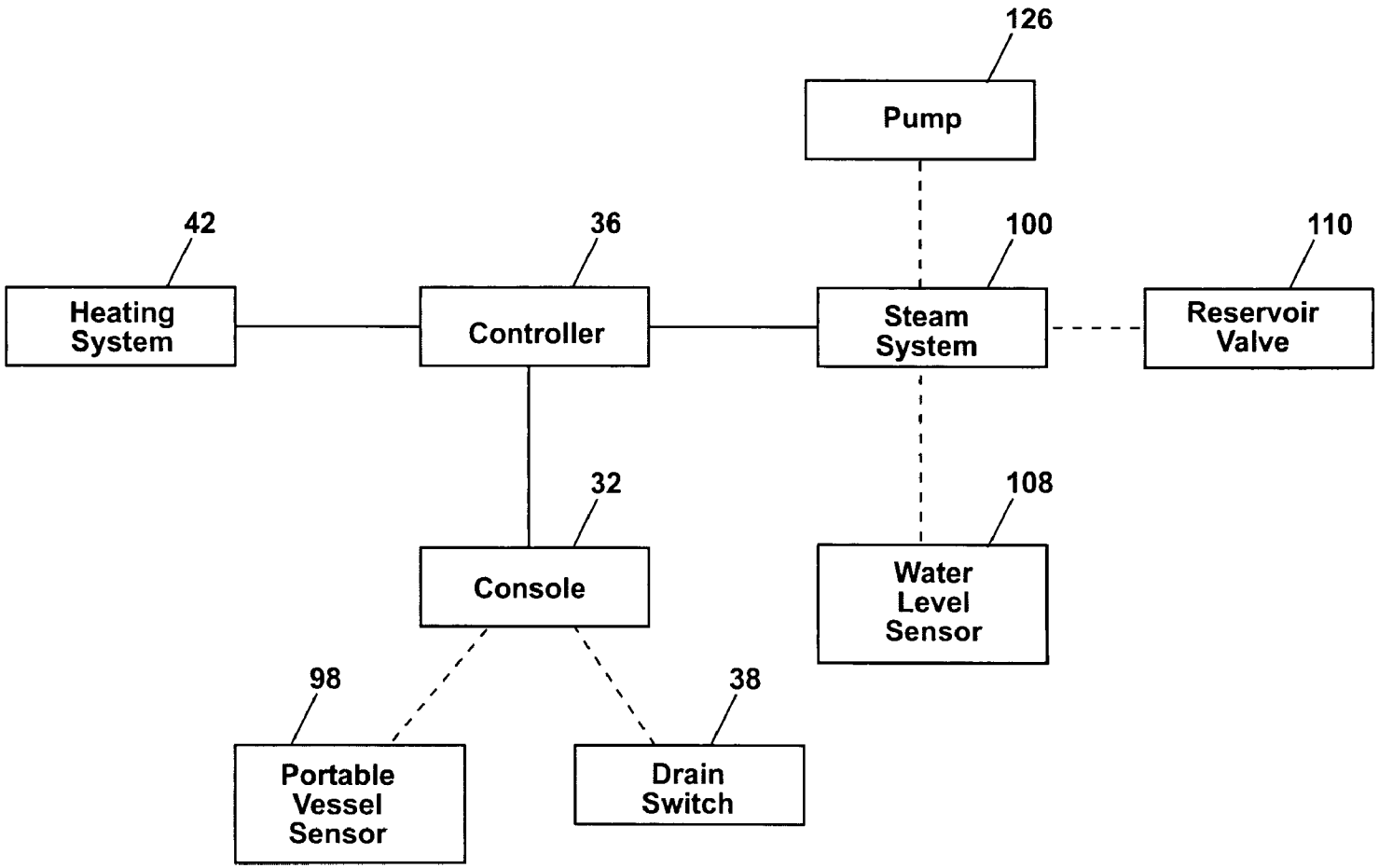
FIG. 4 is a schematic view of a control system according to one embodiment of the invention for the oven shown in FIG. 1.

As shown schematically in FIG. 4, the drain switch 38 is operably coupled to the controller 36, which, in turn, is operably coupled to the pump 126. Additionally, the controller 36 communicates with the vessel sensor 98 such that the controller 36 will not activate the pump 126 unless the vessel sensor 98 detects the presence of the vessel 50. Thus, the pump 126 cannot drain the water from the steam generator 112 unless the vessel 50 is mounted to the docking station 40. FIG. 4 also schematically illustrates the heating system 42 and the water level sensor 108 and the reservoir valve 110 of the steam system 100 as being operably coupled to the controller 36. The controller 36 instructs the heating system 42 to activate or deactivate the upper heating element 44, the lower heating element 46, and the convection fan 48, either all together, individually, or in groups, and provides instructions regarding the desired temperature of the cavity 26 and the rate at which the heating system 42 heats the cavity 26 according to a selected cooking cycle. Similarly, the controller 36 instructs the steam system 100 to activate or deactivate the evaporation element 118 and provides instructions regarding the desired temperature of the water in the steam system 100 which can be monitored by the temperature sensor 122, in order to achieve the desired relative humidity in the cavity 26.

In operation, a user who desires to bake a food item with steam provides water to the steam system 100 through the vessel 50. In particular, the user removes the lid 62 from the tank 52 of the vessel 50 and fills the water supply chamber 66 with water, such as through a conventional kitchen faucet. After the user places the lid 62 on the tank 52, the user mounts the vessel 50 to the docking station 40. When the valves 74, 76 abut the docking console door 90, the door 90 pivots to provide access to the cavity 92 and thereby the valve receivers 94, 96 that receive the valves 74, 76. Upon mating, the valve receivers 94, 96 open the normally closed valves 74, 76 and help support the vessel 50 on the oven 10 so that the user does not have to manually support the vessel 50, and the vessel sensor 98 detects the presence of the vessel 50 and sends a signal to the controller 36. Advantageously, when the vessel 50 is mounted to the oven 10 via the docking station 40, the vessel 50 is located exteriorly of the cabinet 12 and, therefore, does not limit the size of the cooking cavity 26.

When the valve 74 of the outlet fluid port 70 opens, the water in the water supply chamber 66 begins to flow under gravity from the water supply chamber 66 toward the water reservoir 102. When the water level sensor 108 detects that the water reservoir 102 is not substantially full, the reservoir valve 110 is in an open condition to allow water to flow from the water supply chamber 66 to the water reservoir 102. Water continues to flow from the vessel 50 to the water reservoir 102 until the water in the water supply chamber 66 is depleted or until the water level sensor 108 detects that the water reservoir 102 is substantially full. If the water level in the water reservoir 102 rises to a full level, the water level sensor 108 detects the full level, and the reservoir valve 110 assumes a closed condition to prevent water from flowing into the water reservoir 102 through the inlet 104. Because of this feature, the user can mount the portable vessel 50 to the console 40 and leave the portable vessel 50 unattended as it supplies water to the water reservoir 102. The user can return to the portable vessel 50 when desired and remove the portable vessel 50 from the oven 10. As water flows into the water reservoir 102, water also flows in the chamber 116 of the steam generator 112 via the water reservoir outlet 106 and the chamber inlet 114 so that the water level in the steam generator 112 is the same as in the water reservoir 102, as described above. When the steam system 100 has a sufficient amount of water, as determined by the water level sensor 108, the controller 36 can execute a desired automatic or manual cooking cycle, as input by a user through the control panel 32 on the console 34. The user can remove the vessel 50 from the docking station 40 or, if desired, the user can leave the vessel 50 mounted to the docking station 40 during execution of the cooking cycle. If the user removes the vessel 50, the user simply pulls the vessel 50 away from the oven 10, whereby the valves 74, 76 detach from the valve receivers 94, 96 and return to the normally closed position, and the docking console door 90 pivots to conceal the cavity 92.

In addition to employing the vessel 50 to supply water to the steam generator 112, the vessel 50 can be used to drain the water from the steam generator 112. To drain the water, the user mounts the vessel 50 to the docking station 40 in the manner just described for supplying water to the steam generator 112. Upon mating, the valve receivers 94, 96 open the normally closed valves 74, 76, and the vessel sensor 98 detects the presence of the vessel 50 and sends a signal to the controller 36 so that the pump 126 can be operated, as described above. Next, the user actuates the drain switch 38 to activate the pump 126 to pump water from the steam generator drain 124 to the water drain chamber 68 via the inlet fluid port 72. Because the water reservoir 102 is fluidly coupled to the steam generator 112, any water present in the water reservoir 102 will drain with the water from the steam generator 112. After the water is drained from the steam generator 112 into the water drain chamber 68, the user removes the vessel 50 by pulling the vessel 50 away from the oven 10, whereby the valves 74, 76 detach from the valve receivers 94, 96 and return to the normally closed position, and the docking console door 90 pivots to conceal the cavity 92. Next, the user removes the lid 62 from the tank 52 and empties the water drain chamber 68 through the opening 60.

The operation described above for supplying water to and draining water from the steam generator 112 can be performed with a fluid descaling agent or other cleaning fluids rather than water for cleaning the steam system 100. The fluid descaling agent flows through the steam system 100 to remove scale and other materials from the components of the steam system 100.

Figure 5:
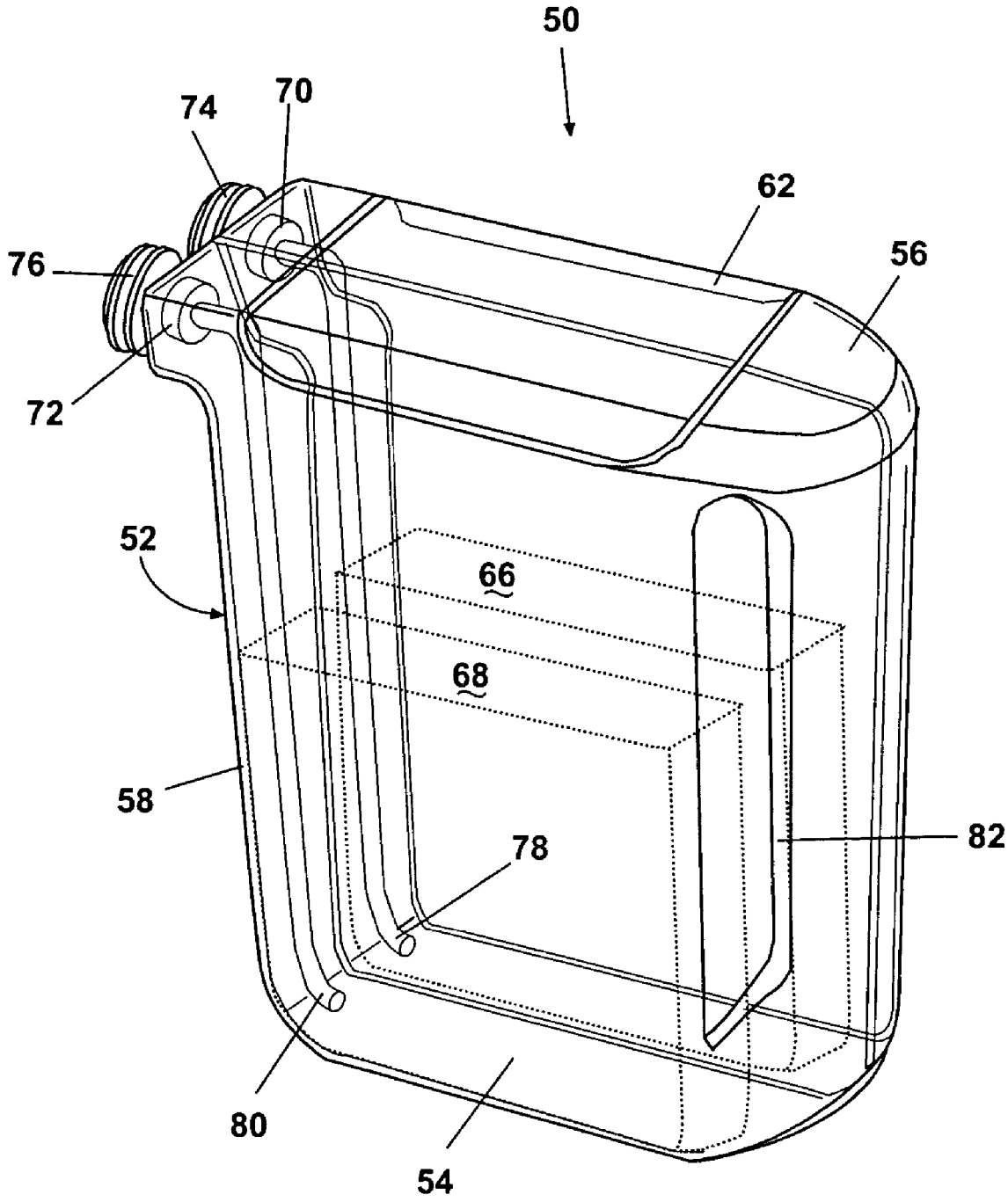
FIG. 5 is a perspective view of a portable supply and drain vessel according to another embodiment of the invention.

A portable vessel 50 according to another embodiment of the invention is illustrated in FIG. 5, where elements similar to those of the first embodiment portable vessel 50 are identified with the same reference numerals. The vessel 50 is substantially identical to the first embodiment vessel 50 of FIG. 2, except that the fluid ports 70, 72 and corresponding valves 74, 76 are located near the top wall 56 of the tank 52 rather than near the bottom wall 54 of the tank 52. As a result of this configuration, the weight of the vessel 50 is supported at an upper end thereof rather than at a lower end thereof, as is the case for the first embodiment vessel 50. When the alternative vessel 50 is utilized, the steam system 100 can be modified as needed for drawing, such as by siphoning or pumping, water from the water supply chamber 66.

While the oven according to the invention has been described above and shown in the figures with respect to illustrative embodiments, it is within the scope of the invention to modify certain aspects of the vessel and the steam system. For example, the vessel can be configured without the dividing wall such that it has only one chamber that functions both as a water supply chamber and a water drain chamber. In this case, the vessel can include separate outlet and inlet fluid ports, or the vessel can comprise a single fluid port that functions as both an outlet and an inlet. Further, when the vessel comprises separate water supply and drain chambers, the chambers can be closed by separate lids rather than a single lid. Additionally, the docking station is not limited to being located in the console; the docking station can be disposed in any suitable location in or on the oven to accommodate the steam system and for improving usability. If the vessel is mounted in a location where a pump is not required to induce a flow of fluid from the steam generator to the vessel, the pump can be omitted and optionally replaced with a valve. For example, the vessel can be mounted in a location vertically below the drain for the steam generator, and the water can flow by gravity to the vessel. In the steam system, the internal reservoir can be integrated with the chamber in the steam generator or omitted such that the water from the vessel is supplied directly from the portable vessel to the steam generator. When the steam system does comprise the water reservoir, the steam system can include a valve positioned between the water reservoir and the steam generator to control the flow of water to the steam generator. Additionally, the steam generator can be any suitable system that is capable of converting water into steam for introduction into the cavity or capable of introducing water into the cavity that is turned into steam in the cavity and is not limited to the system shown schematically in FIG. 3.

While the invention has been specifically described in connection with certain specific embodiments thereof, it is to be understood that this is by way of illustration and not of limitation, and the scope of the appended claims should be construed as broadly as the prior art will permit.

What is claimed is:

1. An oven comprising:

a housing defining a cooking cavity;

a steam generator having an inlet for receiving water, a drain, and a steam outlet operably connected to the cooking cavity for introducing steam into the cooking cavity;

a portable vessel removably mounted to the oven and having a water supply chamber fluidly connected to an outlet of the vessel and a water drain chamber fluidly connected to an inlet of the vessel, which are fluidly coupled to the steam generator inlet and drain, respectively, when the portable vessel is mounted to the oven, whereby the portable vessel supplies water to the steam generator and receives drain water from the steam generator; and a water reservoir fluidly coupled to the steam generator inlet and to the portable vessel outlet when the portable vessel is mounted to the oven.

2. The oven according to claim 1 and further comprising a pump for pumping water from the drain to the vessel inlet.

3. The oven according to claim 2, wherein the pump is located between the drain and the vessel inlet.

4. The oven according to claim 2 and further comprising a switch operable by a user to control operation of the pump.

5. The oven according to claim 4 and further comprising a sensor operable to detect the presence of the portable vessel when the portable vessel is mounted to the oven.

6. The oven according to claim 5 wherein the sensor is operably coupled to the switch such that the switch can only be actuated to activate the pump when the sensor detects the presence of the portable vessel.

7. The oven according to claim 6 and further comprising a docking station that mates with the portable vessel and fluidly couples the portable vessel with the steam generator when the portable vessel is mounted to the oven.

8. The oven according to claim 1 and further comprising a valve downstream of the vessel outlet to control flow of water from the portable vessel to the water reservoir.

9. The oven according to claim 8 and further comprising a water level sensor operable to detect a level of water in the water reservoir and operably coupled to the valve to control the flow of water from the portable vessel to the water reservoir based on the detected level of water.

10. The oven according to claim 1, wherein the steam generator comprises a chamber fluidly coupled to and positioned adjacent to the water reservoir.

11. The oven according to claim 1 and further comprising a docking station that mates with the portable vessel and fluidly couples the portable vessel with the steam generator when the portable vessel is mounted to the oven.

12. The oven according to claim 11 and further comprising a sensor operable to detect the presence of the portable vessel when the portable vessel is mounted to the oven.

13. The oven according to claim 1, wherein the portable vessel further comprises a recloseable lid that selectively closes at least one of the water supply chamber and the water drain chamber when mounted to the portable vessel.

14. The oven according to claim 13, wherein the portable vessel further comprises a handle.

15. An oven comprising:

a housing defining a cooking cavity;

a steam generator having an inlet for receiving water, and a steam outlet operably connected to the cooking cavity for introducing steam into the cooking cavity; and a portable vessel removably mounted to the oven and having a water supply chamber with an outlet and a water drain chamber with an inlet, which are fluidly separate and fluidly coupled to the steam generator inlet and drain, respectively, when the portable vessel is mounted to the oven, whereby the portable vessel supplies water to the steam generator from the water supply chamber and receives drain water in the water drain chamber from the steam generator to maintain fluid separation between the supplied water and drained water.

16. The oven according to claim 15 and further comprising a pump for pumping water from the drain to the vessel inlet.

17. The oven according to claim 16 and further comprising a switch operable by a user to control operation of the pump.

18. The oven according to claim 17 and further comprising a sensor operable to detect the presence of the portable vessel when the portable vessel is mounted to the oven.

19. The oven according to claim 18 wherein the sensor is operably coupled to the switch such that the switch can only be actuated to activate the pump when the sensor detects the presence of the portable vessel.

20. The oven according to claim 15 and further comprising a docking station that mates with the portable vessel and fluidly couples the portable vessel with the steam generator when the portable vessel is mounted to the oven.

21. The oven according to claim 15, wherein the portable vessel further comprises a recloseable lid that selectively closes at least one of the water supply chamber and the water drain chamber when mounted to the portable vessel.

22. The oven according to claim 21, wherein the portable vessel further comprises a handle.

* * * * *

UNITED STATES PATENT AND TRADEMARK OFFICE

CERTIFICATE OF CORRECTION

PATENT NO. : 7,537,004 B2
APPLICATION NO. : 11/120407
DATED : May 26, 2009
INVENTOR(S) : Malcolm Reay It is certified that error appears in the above-identified patent and that said Letters Patent is hereby corrected as shown below:

In column 8, line 31 (claim 15), insert --a drain,-- after "...an inlet for receiving water,".

Signed and Sealed this

Twenty-fifth Day of August, 2009

David J. Kappos

David J. Kappos
*Director of the United States Patent and Trademark Office*